US010013016B2

(12) United States Patent
Fuller

(10) Patent No.: US 10,013,016 B2
(45) Date of Patent: Jul. 3, 2018

(54) METHOD AND INSTRUCTION FOR ATTACHMENT OF ETC PEDAL TO BRACKET

(71) Applicant: KSR Technologies Co., Ridgetown (CA)

(72) Inventor: Shaun Matthew Fuller, Ridgetown (CA)

(73) Assignee: KSR IP Holdings LLC., Wilmington, DE (US)

( * ) Notice: Subject to any disclaimer, the term of this patent is extended or adjusted under 35 U.S.C. 154(b) by 419 days.

(21) Appl. No.: 13/803,036

(22) Filed: Mar. 14, 2013

(65) Prior Publication Data

US 2013/0239737 A1 Sep. 19, 2013

Related U.S. Application Data

(60) Provisional application No. 61/610,619, filed on Mar. 14, 2012.

(51) Int. Cl.
*G05G 1/46* (2008.04)
*G05G 1/50* (2008.04)

(52) U.S. Cl.
CPC ..... *G05G 1/46* (2013.01); *G05G 1/50* (2013.01); *Y10T 29/49622* (2015.01); *Y10T 74/20528* (2015.01)

(58) Field of Classification Search
CPC .. G05G 1/46; G05G 1/50; G05G 1/44; G05G 1/445; G05G 1/38; G05G 1/30;
(Continued)

(56) References Cited

U.S. PATENT DOCUMENTS 3,500,702 A * 3/1970 Nautsch et al. ..... 74/560
5,385,068 A 1/1995 White et al.
(Continued)

FOREIGN PATENT DOCUMENTS

DE 10135537 A1 * 1/2003
DE 102004047711 A1 * 5/2005 ..... B60K 23/02
(Continued)

OTHER PUBLICATIONS

EPO Translation of the Description of DE 102004047711 A1, Johansson, May 25, 2005.*

*Primary Examiner* — Daniel D Yabut
(74) *Attorney, Agent, or Firm* — Dinsmore & Shohl LLP

(57) ABSTRACT

The present invention provides for a method of manufacturing and installing an electronic throttle control pedal to a bracket within a vehicle. The method includes the steps of making a customized pedal mounting bracket for a vehicle wherein the customized pedal mounting bracket has universal connecting features. The method further includes mounting the customized pedal mounting bracket to a vehicle and attaching the universal pedal housing to the customized pedal mounting bracket by means of the universal connecting features. An apparatus of the present invention including a universal pedal housing having a rear surface wherein the rear surface includes at least one locating protrusion. The pedal housing further including a plurality of compression tabs. The apparatus including a pedal mounting bracket having a front surface wherein the rear surface of the pedal housing connects to the front surface of the pedal mounting bracket.

5 Claims, 5 Drawing Sheets

(58) Field of Classification Search
CPC ..... G05G 5/03; G05G 5/05; B60K 26/021; B60K 26/02; Y10T 74/20528; Y10T 74/20534; Y10T 74/2054; Y10T 74/20888
See application file for complete search history.

(56) References Cited

U.S. PATENT DOCUMENTS

| | | | | | |
|---|---|---|---|---|---|
| 5,408,899 | A * | 4/1995 | Stewart | B60K 26/021 | 123/399 |
| 7,191,759 | B2 | 3/2007 | Lee | | |
| 7,216,563 | B2 | 5/2007 | Willemsen et al. | | |
| 7,946,192 | B2 * | 5/2011 | Kim et al. | 74/513 | |
| 2007/0234842 | A1 | 10/2007 | Elliott | | |
| 2008/0202279 | A1 * | 8/2008 | Burgstaler et al. | 74/513 | |
| 2010/0319480 | A1 * | 12/2010 | Nebuya et al. | 74/513 | |
| 2011/0100153 | A1 | 5/2011 | Kaijala et al. | | |
| 2012/0085196 | A1 * | 4/2012 | Watanabe | 74/513 | |
| 2012/0325990 | A1 * | 12/2012 | Ishizuki et al. | 248/205.1 | |

FOREIGN PATENT DOCUMENTS

| | | | | |
|---|---|---|---|---|
| DE | 102005053665 | A1 * | 5/2007 | B60K 26/02 |
| DE | 102005057598 | A1 * | 6/2007 | B60K 26/02 |
| FR | 2958228 | A1 * | 10/2011 | B60K 26/02 |
| WO | 9814857 | A1 | 4/1998 | |
| WO | 06078579 | A2 | 7/2006 | |

* cited by examiner

METHOD AND INSTRUCTION FOR ATTACHMENT OF ETC PEDAL TO BRACKET

CROSS-REFERENCE TO RELATED APPLICATIONS

This application claims priority of U.S. Provisional Application 61/610,619 filed Mar. 14, 2012, the contents of which are incorporated herein by reference.

BACKGROUND OF THE INVENTION

It is known to make pedal assemblies with electronic throttle control (ETC) having parts molded from plastic. These known systems typically include a molded plastic housing which supports a pedal arm for pivotal movement and a position sensor for determining the amount of depression of the pedal. Typically these housings also include some sort of hysteresis or feedback device which resists depression of the pedal to simulate the feel of a mechanical pedal system. The housing typically has tabs or other features which permit mounting to a vehicle. However, each vehicle has different surfaces for mounting the pedal assembly. The surface may be broken into different areas or angle according to different needs. Thus, each housing must be designed to meet the space and packaging requirements for the vehicle. Each pedal assembly must be designed from scratch. Accordingly, it would be desirable to have a pedal assembly which would be easily adapted for use in different models of vehicles.

SUMMARY OF THE INVENTION

The present invention provides for a method of manufacturing and installing an electronic throttle control pedal to a bracket within a vehicle. The method includes the steps of making a customized pedal mounting bracket for a vehicle wherein the customized pedal mounting bracket has universal connecting features. The method further includes mounting the customized pedal mounting bracket to a vehicle and attaching the universal pedal housing to the customized pedal mounting bracket by means of the universal connecting features. The pedal housing is then secured to the customized pedal mounting bracket by means of the universal connecting features. An apparatus of the present invention including a universal pedal housing having a rear surface wherein the rear surface includes at least one locating protrusion. The pedal housing further including a plurality of compression tabs. The apparatus further including a pedal mounting bracket having a front surface wherein the rear surface of the pedal housing connects to the front surface of the pedal mounting bracket. The front surface of the pedal mounting bracket having at least one aperture operable to connect to the at least one protrusion and the plurality of compression tabs.

The pedal assembly utilizes a standardized housing module mounted to a bracket wherein the bracket is customized for a particular vehicle model. The housing includes tabs and features which interact with the bracket to compressibly mount the housing to the bracket. A single screw is used to secure the housing to the bracket. The housing and the bracket are molded of a suitable plastic.

DETAILED DESCRIPTION OF THE DRAWINGS

Figure 1:
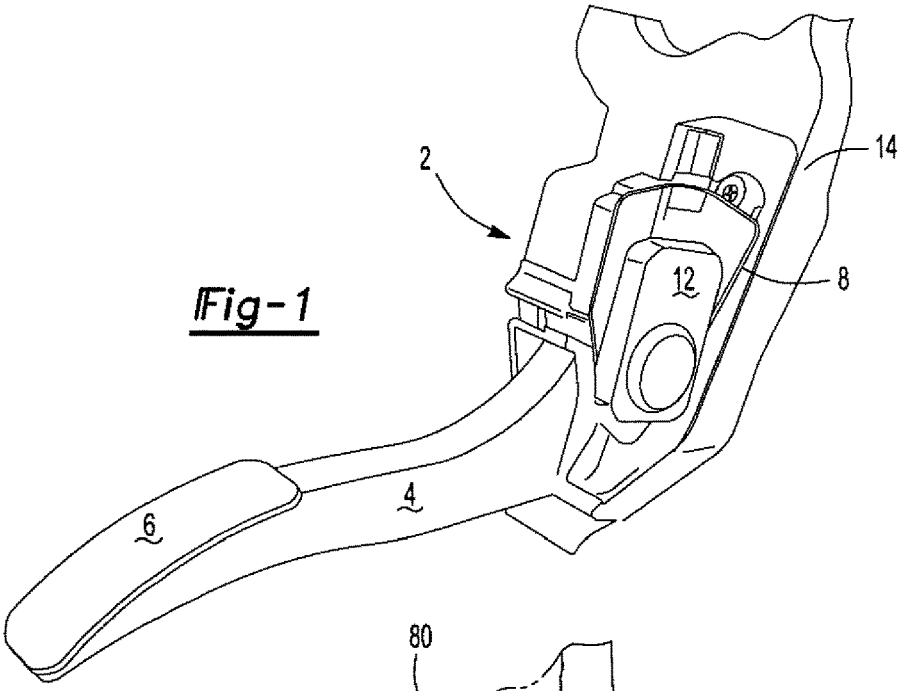
FIG. 1 illustrates a perspective environmental view of the present invention.

A method and apparatus for a two component pedal assembly utilizing a standardized housing module mounted to a bracket which is customized for a particular vehicle model. The vehicle housing includes tabs and features which interact with the bracket to compressibly mount the housing to the bracket. A single screw is used to secure the housing to the bracket. The housing and the bracket are molded of a suitable plastic. The bracket is customized from vehicle to vehicle but includes standardized attachment features corresponding to attachment features on the pedal housing. FIG. 1 illustrates a perspective environmental view of the bracket and housing of the present invention. The assembly 2 includes a pedal arm 4 and a pedal pad 6. A pedal mounting portion 8 is provided within the assembly 2. The electronic throttle control (ETC) is mounted within the compartment 8 and connected to the pedal arm 4 and pedal pad 6.

Figure 2:
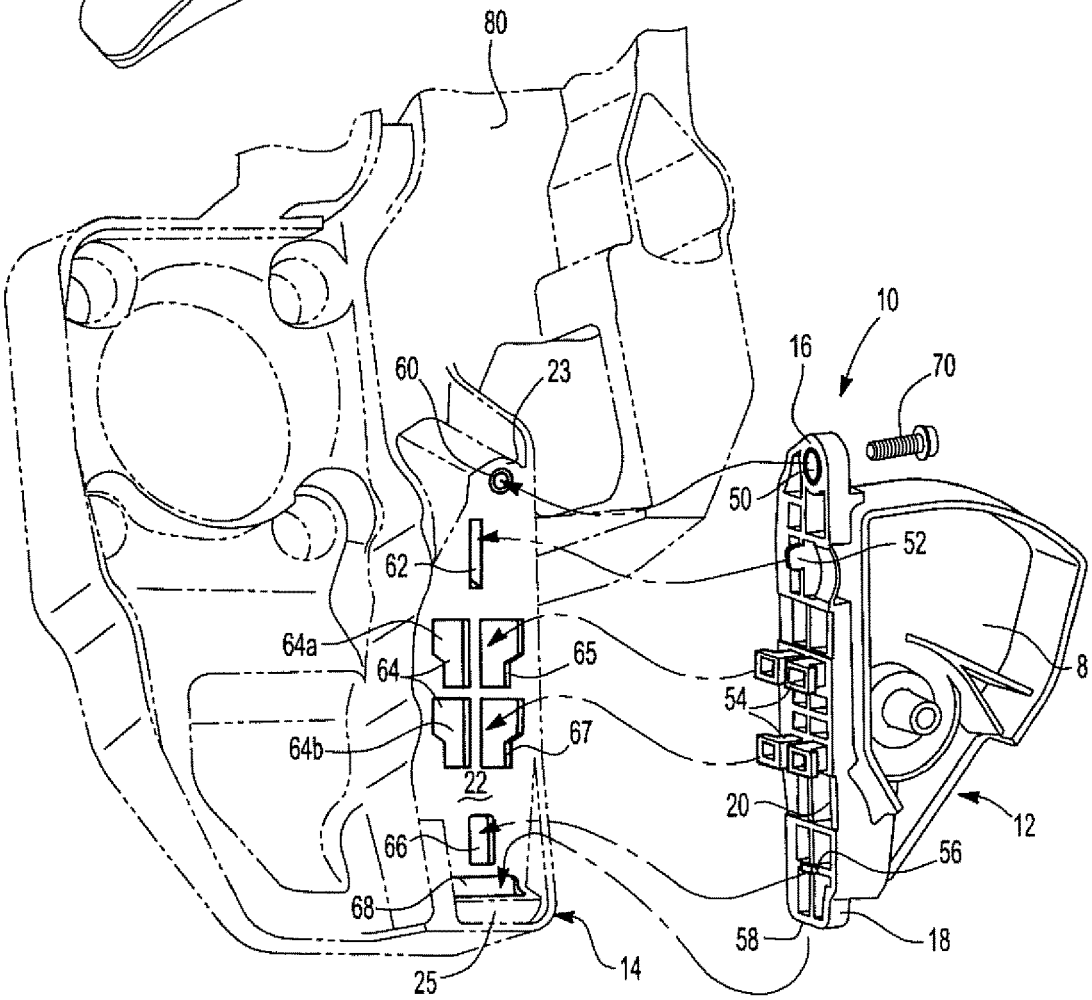
FIG. 2 illustrates an exploded perspective view of the bracket and the housing of the present invention.
Figure 3:
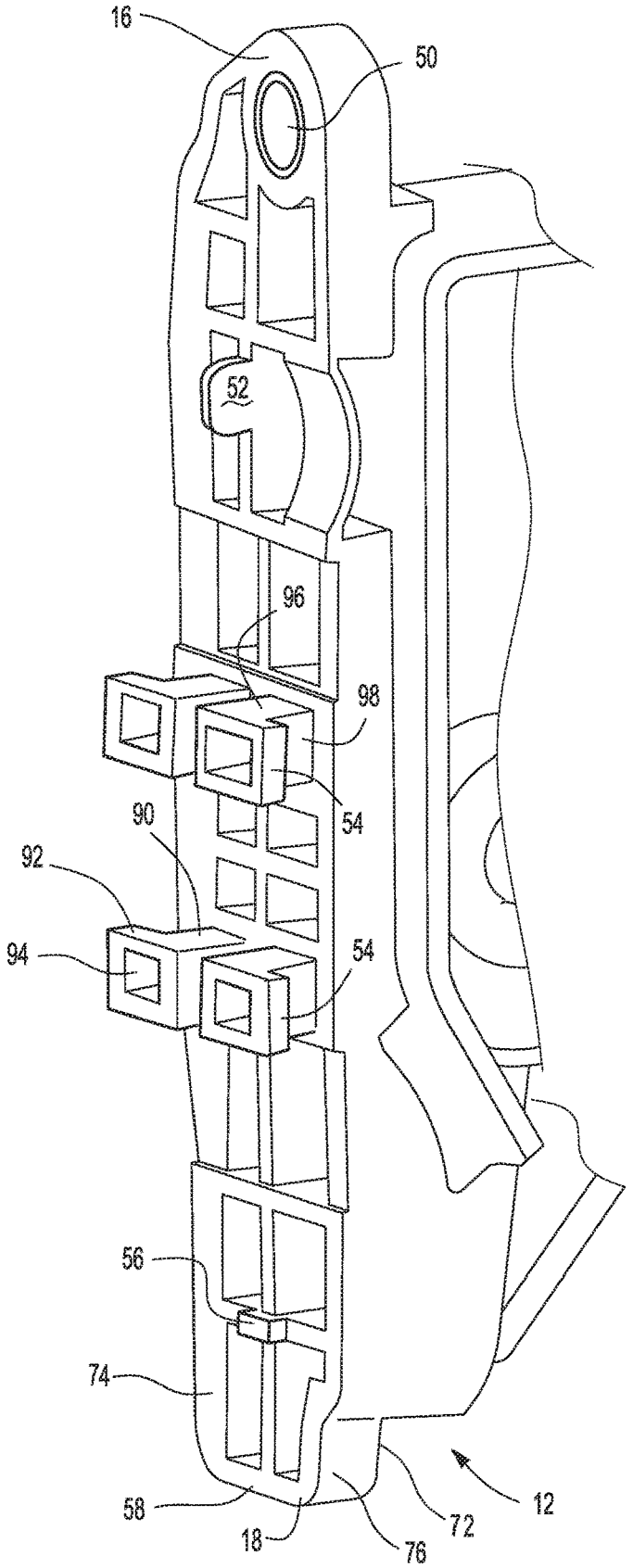
FIG. 3 illustrates a view of the back surface of the housing of the present invention.
Figure 6:
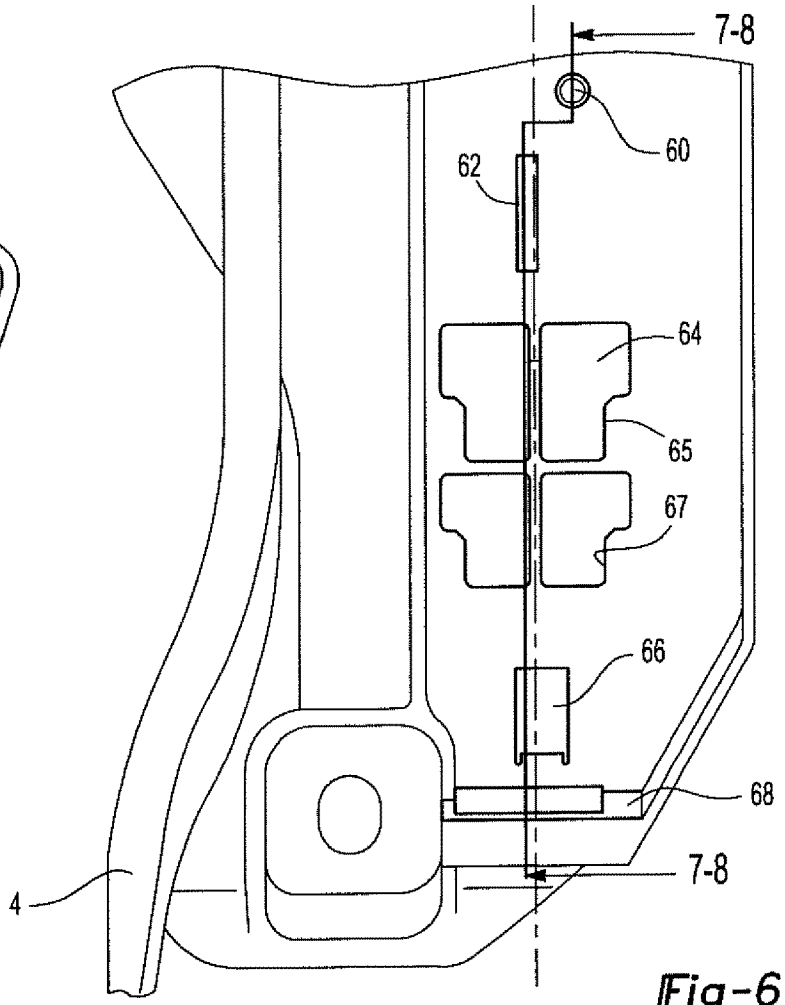
FIG. 6 illustrates a front view of the bracket of the present invention.
Figure 5:
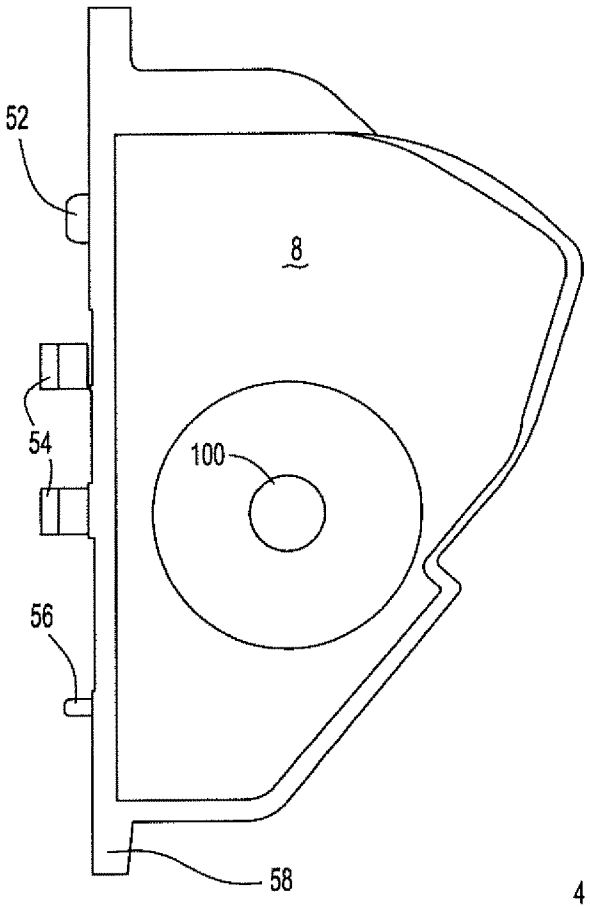
FIG. 5 illustrates a cross-sectional view of the housing of the present invention.
Figure 4:
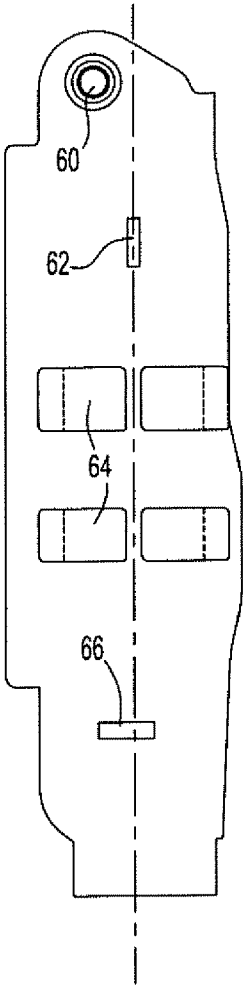
FIG. 4 illustrates a cross-sectional view of the bracket of the present invention.

FIG. 2 illustrates an exploded perspective view of the apparatus 10 of the present invention. The apparatus or assembly 10 includes a housing 12 and a bracket 14. The housing 14 includes an upper end 16 and a lower end 18. The housing 12 further includes a rear surface 20 and the previously discussed mounting portion 8. In the present embodiment, the rear surface 20 is arranged in a grate or slotted type fashion. In alternative embodiments, the rear surface 20 is a solid or planar surface.

The bracket 14 includes a front surface 22. The bracket 14 further includes an upper end 23 and a lower end 25. The front surface 22, in the present embodiment, is generally planar.

The housing 12 includes the upper end 16 and the lower end 18. An aperture 50 is disposed at the upper end of the housing 12. Various other protrusions, apertures, and the like are provided having various configurations. A protrusion 52 is provided extending away from the rear surface 20. The protrusion 52 is generally planar having rounded edges.

A plurality of compression tabs 54 are further provided extending away from the rear surface 20. The tabs 54 are generally L-shaped. Further provided is protrusion 56 extending away from the rear surface 20 of the housing 12. The lower end 18 of the housing 12 further includes the protrusion 58. The protrusion 58 extends away from the main body of the housing 12.

The bracket 14 includes the upper portion 23 and the lower portion 25. The upper portion 23 includes an aperture 60 operable to connect with the aperture 50 of the housing 12. A bolt 70 is used to secure the housing 12 to the bracket 14 through the aperture 50 and then through the aperture 60.

Figure 8:
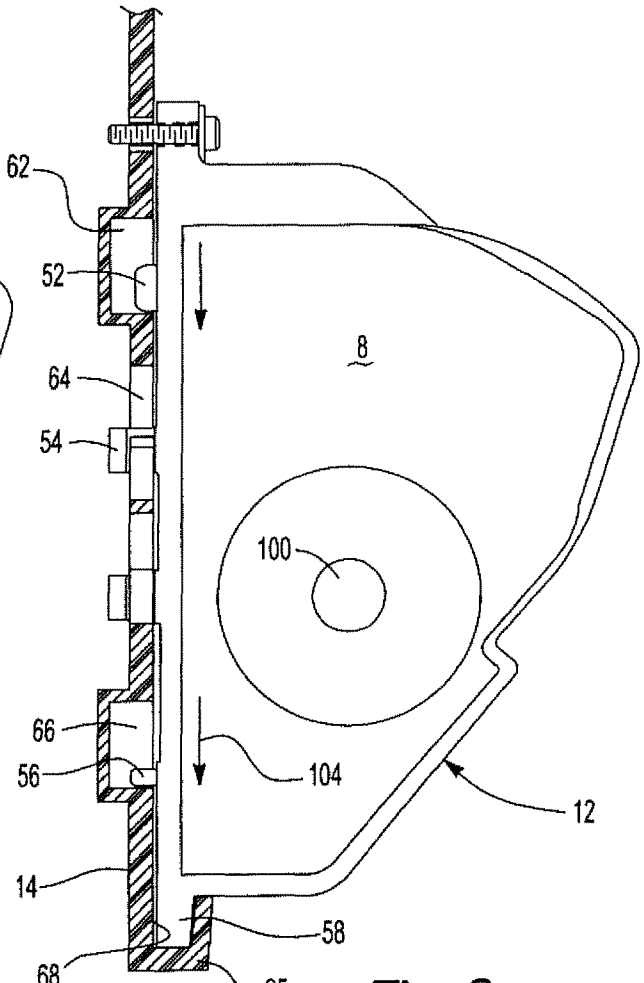
FIG. 8 illustrates the bracket and housing in an installed position.

The front surface 22 of the bracket 14 further includes the aperture 62 operable to connect and interact with the protrusion 52. Furthermore, apertures 64 are provided on the front surface 22 of the bracket 14. The apertures 64 are adapted to interact with the protrusions or tabs 54. The apertures 64 include an upper portion 64*a* and a lower portion 64*b*. The upper portions 64*a* of the apertures 64 are wider in dimension as compared to the lower portions 64*b* of the apertures 64. The lower portion 64*a* being shorter in width creates the extra space 65. As the compression tabs 54 are inserted into the upper portion 64*a* of the aperture 64, they are then slid downwards as shown in FIG. 8 allowing a portion of the tabs 54 to overlap the extra portion 65. The inner walls 67 of the aperture 64 press against the tabs 54 thereby holding them in compression.

The front surface 22 of the bracket 14 further includes aperture 66 operable to connect and interact with the protrusion 56. The lower end 25 of the bracket 14 further includes a receiving portion 27 with a wall portion 29 spaced apart from the front surface 22 to define a cup or aperture 68 operable to connect with the large protrusion 58 of the housing 12. The cup or aperture 68 has a base and spaced apart walls forming a generally U-shape structure to receive the large protrusion 58. The protrusion 58 of the housing 12 sits within the cup or aperture 68 of the bracket 14 wherein the cup or aperture 68 receiving portion 27 and bracket enclose the large protrusion 58 on all four sides. The four sides include a top 72, bottom 74, and two side walls 76. The mounting portions and surfaces 22, 20 are generally rectangular in profile with a generally outer planar surface.

The compression tabs 54 include an extended intermediate portion 90 connected to extension distal portion 92. The extended intermediate portion 90 and the extension distal portion 92 are connected in a generally L-shaped configuration forming a 90 degree angle. The distal portion has a width "W" greater than the width "I" of the intermediate portion. In the present embodiment, the compression tabs 54 include an aperture 94. The compression tabs 54 further include an upper surface 96. In the present embodiment, the upper surface is generally L-shaped. The compression tabs 54 further include an inner surface 98 operable to connect with and interact with the inner surface 67 of the aperture 64.

Figure 7:
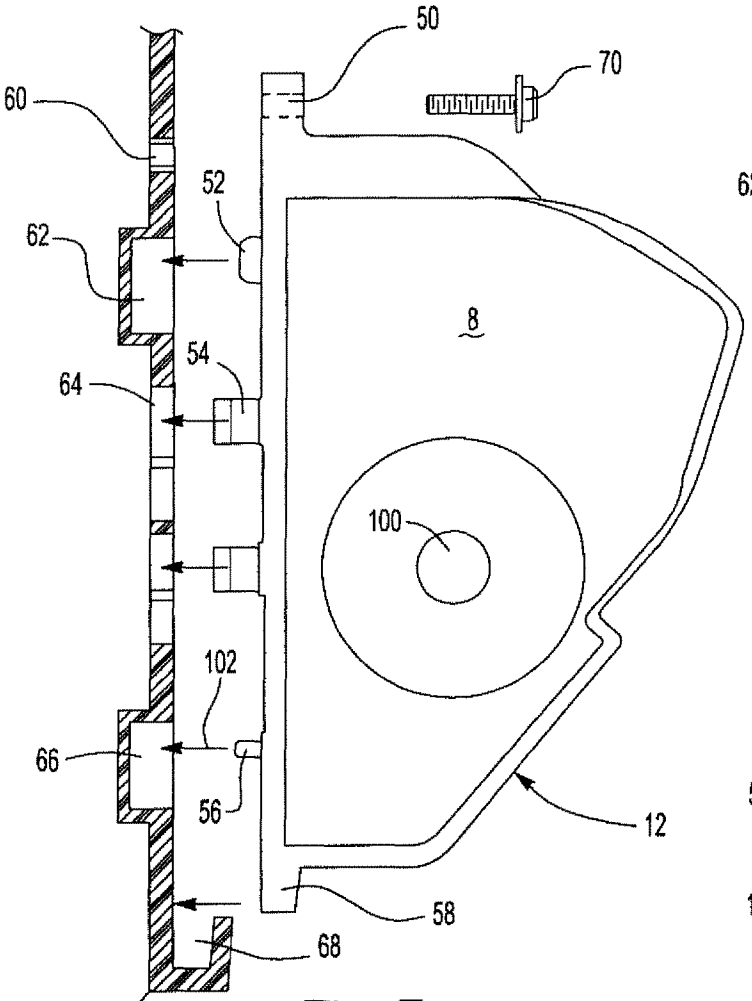
FIG. 7 illustrates a cross-sectional view of the bracket and housing in a preinstalled position.
Figure 9:
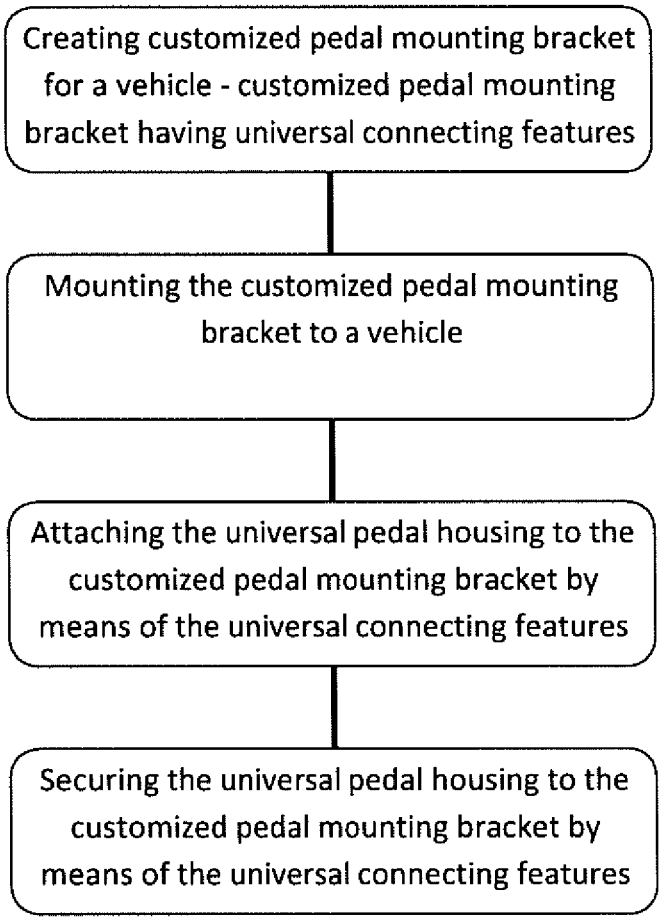
FIG. 9 illustrates a flowchart of the method of the present invention.

FIGS. 7 and 8 illustrate the installment of the housing 12 into the bracket 14. The various protrusions 52, 56 are inserted into the corresponding apertures 62, 66. The compression tabs 54 are inserted into the apertures 64. Once the protrusions are inserted within the apertures, the user then slides 104 the housing 12 down towards the lower end 25 of the bracket 14. The various protrusions 52, 56, 58 are used to align the housing 12 with the bracket 14. As the user slides the housing into place, the protrusion 58 of the housing 12 is inserted into the cup 68 of the bracket 14. The cup 68 allows the housing 12 to rest securely within the bracket 14.

The compression tabs 54 of the housing 12 are slid into place in the apertures 64. As the user inserts 102 the housing 12 into the bracket 14 and slides downward 104 the housing 12 into the bracket 14, the inner surface 98 of the compression tabs 54 comes into contact with the inner surface 67 of the apertures 64. The compression against the inner surface 67 of the apertures 54 further secures the housing 12 to the bracket 14.

The method of the present invention provides for creating a customized mounting bracket for each vehicle while keeping the specifics and design of the housing of the pedal assembly standardized. The method includes the steps of creating a customized pedal mounting bracket for a vehicle wherein the customized pedal mounting bracket includes universal connecting features. These universal connecting features include the various apertures and protrusions and tabs discussed above. The customized pedal mounting bracket varies from vehicle make and model. As shown in FIG. 2, various attachment structures and features are utilized to securely connect the bracket 14 to the vehicle 80. The designer molds various bracket shapes and customizes them from vehicle to vehicle while the housing of the pedal 12 remains standardized. The method further includes the step of mounting the customized pedal mounting bracket to the vehicle. The method then includes the step of attaching the universal pedal housing to the customized pedal mounting bracket by means of the universal connecting features, such as the feature discussed above. The method then includes the step of securing the universal pedal housing to the customized pedal mounting bracket by means of the universal connecting features. The various apertures and protrusions discussed above are used as the universal connecting features. Various fasteners are also used to connect the housing to the bracket.

The housing 12 of the present invention includes an outer portion having the mounting portion or cavity 8. The cavity 8 includes a pivot pin 100 for supporting the pedal arm 4 and a chamber for a hysteresis device. Any type of hysteresis device may be utilized, however a suitable type is shown in U.S. patent application Ser. No. 11/697,333. The cavity and chamber are covered with a cover which includes a position sensor. In the preferred embodiment, the position sensor is a noncontacting position sensor such as those manufactured by the assignee of the application and shown in U.S. Pat. No. 7,191,759.

The protrusion 58 located on the lower end 18 of the housing 12 has a generally rectangular profile which is adapted to be received within a correspondingly shaped opening or cup 68 on the bracket 14. The various protrusions 52, 56 are used for guiding the housing 12 during assembly. These protrusions are used to align and assist in assembly.

As shown in FIGS. 2-9, the bracket is generally rectangular and has apertures formed in each end to receive fasteners for mounting to the vehicle. The front surface 22 of the bracket 14 includes the apertures 64. The apertures 64 include engagement flanges 65 extending into the apertures 64. The engagement flanges 65 extend into a corner of each aperture from the surface 22.

Thus is disclosed a pedal assembly having mounting features which permit easy assembly, proper alignment, and permit a base bracket assembly which may be easily modified for different vehicle model applications.

Having thus disclosed the invention with respect to the preferred embodiments, it will be apparent to one skilled in the art that there are many different variations of the invention within the scope of the invention.

The invention is not restricted to the illustrative examples and embodiments described above. The embodiments are not intended as limitations on the scope of the invention. Methods, apparatus, compositions, and the like described herein are exemplary and not intended as limitations on the scope of the invention. Changes therein and other uses will occur to those skilled in the art. The scope of the invention is defined by the scope of the appended claims.

The invention claimed is:

1. An apparatus for connection of an electronic throttle control pedal to a bracket within a vehicle, the apparatus comprising:

a housing having an electronic throttle control and a pedal arm, the housing having a base having a pair of ends and a rear surface extending between the pair of ends, a protrusion extending from one end of the pair of ends, the protrusion having four sides, and the rear surface of the housing having at least one pair of tabs, the protrusion is spaced apart from the at least one pair of tabs, each of the pair of tabs having an intermediate portion extending normally outwardly from the rear surface of the base at a position between the pair of ends, each of the at least one pair of tabs having a distal portion, each intermediate portion having a pair of spaced apart sides, the distal portion having a width greater than the width of the width of the intermediate portion;

a bracket having a surface and a receiving portion extending outwardly from the surface, a surface receiving portion having a wall spaced apart from the surface to form a u-shaped cup adapted to enclose the four sides of the protrusion, the surface having at least one pair of apertures, each aperture of said at least one pair of apertures having a first portion and a second portion, the first portion having a width greater than the second portion to accept the distal portion of the tab, the second portion having a pair of edges, said edges adapted to receive the sides of the intermediate portion in compression.

2. The attachment apparatus of 1 wherein a first end of the housing includes a mounting aperture.

3. The attachment apparatus of claim 2 wherein the mounting aperture connects to the bracket by means of a fastener.

4. The attachment apparatus of claim 3 wherein the fastener is a bolt.

5. The attachment apparatus of claim 1 wherein the tabs are generally L-shaped.

* * * * *